US007980321B2

(12) United States Patent
Happ

(10) Patent No.: US 7,980,321 B2
(45) Date of Patent: Jul. 19, 2011

(54) ANVIL FOR A POWER TOOL

(75) Inventor: Kenneth C. Happ, Burlington, WI (US)

(73) Assignee: Snap-On Incorporated, Kenosha, WI (US)

( * ) Notice: Subject to any disclaimer, the term of this patent is extended or adjusted under 35 U.S.C. 154(b) by 0 days.

(21) Appl. No.: 11/872,583

(22) Filed: Oct. 15, 2007

(65) Prior Publication Data

US 2008/0087448 A1 Apr. 17, 2008

Related U.S. Application Data

(60) Provisional application No. 60/851,720, filed on Oct. 13, 2006.

(51) Int. Cl.
*B25D 17/00* (2006.01)

(52) U.S. Cl. ..... 173/128; 173/93; 173/93.5; 173/93.6

(58) Field of Classification Search ..... 173/93, 173/93.5, 93.6, 176, 179, 216; 81/54; 403/365
See application file for complete search history.

(56) References Cited

U.S. PATENT DOCUMENTS 2,563,711 A * 8/1951 Fitch ..... 173/93.6
2,890,072 A 6/1959 Kaman et al.
2,987,334 A * 6/1961 Wendling ..... 403/8
3,156,334 A * 11/1964 Hoza ..... 173/93.6
3,222,096 A 12/1965 Kaman
3,531,144 A * 9/1970 Bizilia ..... 403/326
5,038,869 A * 8/1991 Olson ..... 173/93
6,227,308 B1 * 5/2001 Ghode et al. ..... 173/93
6,302,001 B1 10/2001 Karle
6,983,808 B1 * 1/2006 Chen ..... 173/93.5
7,036,406 B2 * 5/2006 Milbourne et al. ..... 81/466
7,083,003 B1 * 8/2006 Pusateri et al. ..... 173/29

* cited by examiner

*Primary Examiner* — Rinaldi I Rada
*Assistant Examiner* — Nathaniel Chukwurah
(74) *Attorney, Agent, or Firm* — Barnes & Thornburg LLP

(57) ABSTRACT

The present disclosure relates to an anvil, an anvil and socket combination and an anvil attached to a power tool. The anvil structure includes a drive head with an end and a body portion having a channel spaced there between. A friction ring is retained in the channel. Flats are provided on the end and on the sides of the end and the square portion in a coordinating alignment such that the flats generally lie in the same plane. The ring retained in the channel between the end and the portion at least partially extends relative to the flap. A transition cone is provided on the anvil for distributing impact load. Additional, relief grooves are provided on corners of the polygon portion to help further relieve stress in the anvil structure.

25 Claims, 6 Drawing Sheets

ANVIL FOR A POWER TOOL

CROSS REFERENCE TO RELATED APPLICATIONS

This application claims priority under 35 U.S.C. §119(e) to U.S. Provisional Patent Application No. 60/851,720, filed Oct. 13, 2006, the contents of which are expressly incorporated herein by reference in their entirety.

BACKGROUND

This disclosure relates generally to power tools and hand tools and more particularly to an anvil for a power tool, hand tool or both.

The present disclosure relates to an anvil for use with a tool. The anvil is used on a powered drill, screwdriver or other power hand tool or hand tool to engage a corresponding socket. The anvil is typically a male component which engages a corresponding female component such as a socket head.

The anvil in accordance with the present disclosure includes a drive end and a drive body axially spaced from the drive end. The drive end is generally disk-shaped but includes lateral engaging surfaces in the form of flats for facilitating engagement between the anvil and the socket head. A channel is defined between the drive end and the drive body for receiving a friction ring, which may be in the form of an o-ring, split ring or the like, which also facilitates engagement between the anvil and socket.

The drive body includes a male square portion, and the lateral span of the flats generally align with the lateral span of the flat portions of the male square portion. The outer radial dimension of the ring generally corresponds to the radial dimension of the drive end. As a result, the ring will only extend outwardly away from the anvil along the flats of the drive end. The flats provide "pre-alignment" of the drive body when engaging with a socket and help align the male square portion and the socket before the friction ring is engaged with the socket.

Features and advantages of the disclosure will be set forth in part in the description which follows and the accompanying drawings described below, wherein an embodiment of the disclosure is described and shown, and in part will become apparent upon examination of the following detailed description taken in conjunction with the accompanying drawings.

DETAILED DESCRIPTION

Figure 1:
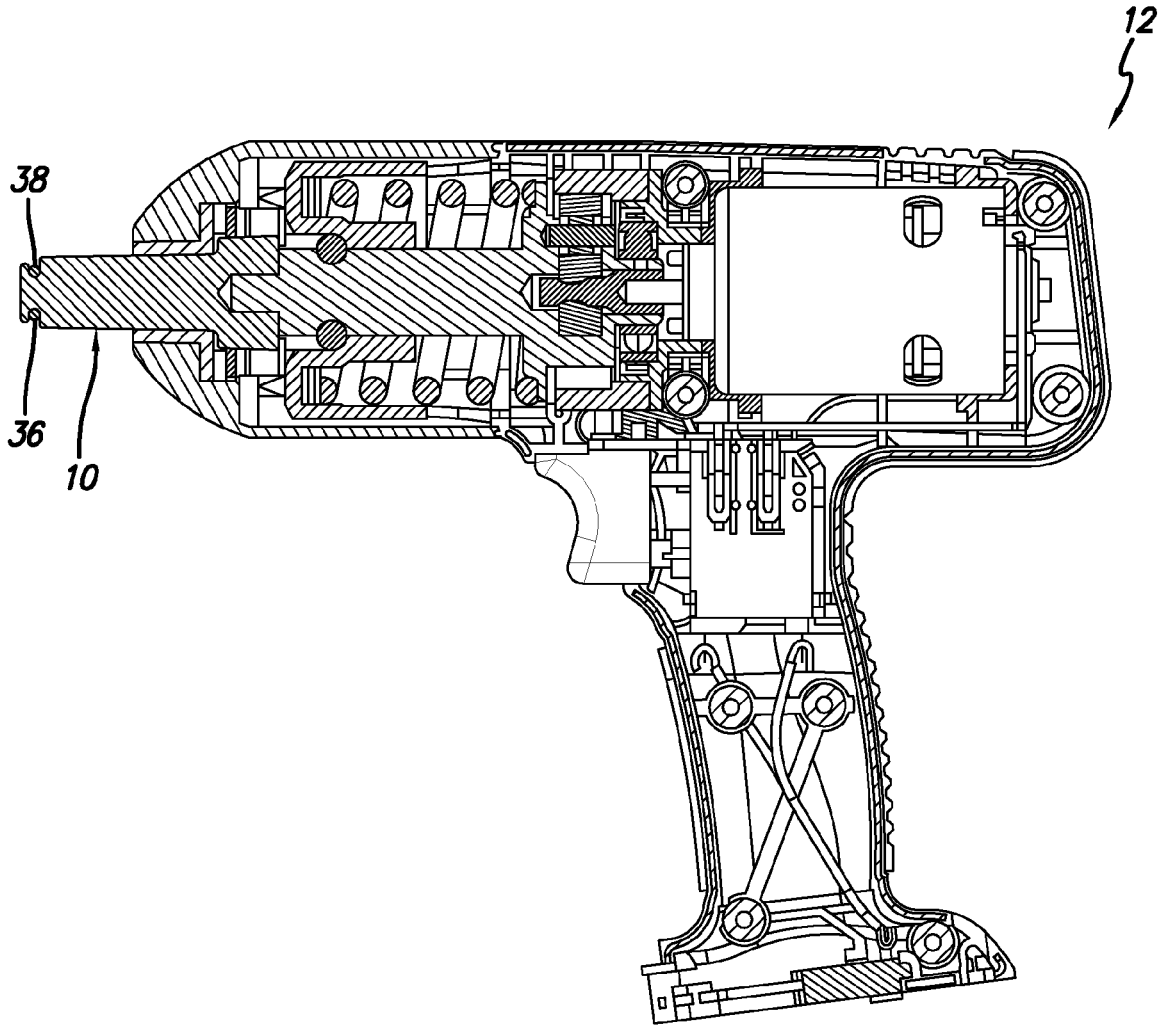
FIG. 1 is a cross section view of a rotary impact power tool including an anvil position at a front end of the tool for engagement with a socket of a device to be driven by the tool.

FIGS. 1-11 illustrate an anvil 10 in accordance with an embodiment of the present disclosure for a rotary impact power tool 12. The anvil 10 includes a base 14 having a pair of lateral engaging flanges 16 and an anvil shaft 20 including a drive body 24 that includes a reduced diameter portion 26, a cone-shaped transition portion 28, a male square portion 30 and a drive end 32. While references made to a rotary impact power tool, it is envisioned that reference to a tool is to be broadly interpreted. In this regard, the tool need not be a power nor need it be a delivery power, if it is a power tool. The disclosure herein provides information relevant to the connection between an anvil or head and any corresponding socket. In this regard, the structures and functions disclosed will be applicable to tools in addition to rotary power tools. With the foregoing in mind, it is envisioned that reference to the term "tool" is to be provided as an illustration and not a limitation in the interpretation of the present application. Rather, tool is intended to be broadly interpreted and applicable to any situation in which one component is attached to another component and will benefit from the present disclosure.

The drive end 32 has a disk shape and includes four circumferentially-spaced flats 34, and a channel 36 is defined between the drive end 32 and the male square portion 30. The flats are positioned on the circumferential portions of the drive end. The channel 36 receives a friction structure 38 which is in the form of a friction ring. The flats 34 of the drive end 32 align with the flat portions 40 formed on the male square portion 30. The outer diameter of the ring 38 generally corresponds to the outer radial dimension of the drive end 32. As a result, the ring 38 will only protrude outwardly from the anvil 10 adjacent the flats 34. The flats 34 provide "pre-alignment" of the anvil when engaging it with a socket 42 and help align the male square portion 30 and the female portion 44 defined by the socket 42 before the friction ring 38 is engaged with the socket 42.

While a square, four sided or otherwise rectilinear cross-sectional structure is disclosed herein, it is anticipated that other structures may be equally supported by the present disclosure. In this regard, any of the generally pentagonal cross-sections may be suitable. Such cross-sectional structures include but are not limited to triangular, squared, rectangular, pentagon, hexagon, or any other additional polygon cross-section. As will be described in greater detail herein below the specific number of sides is not as important as the relationship between the various structures associated with the sides. As such, the present disclosure is intended to include any of a variety of pentagonal shapes either regular or irregular and encompass the present invention. The use of a square cross-sectional structure in the present disclosure is intended to provide an illustration but not a limitation as to the structure or range of structures that might be used. As such, reference to a "square" portion is intended to be broadly interpreted and not limiting in the present disclosure. However, it is anticipated that the cross-sectional area of the selected polygon shape will generally correspond to the cross-sectional shape of the opening associated with the socket (See FIG. 3). However, it is anticipated that a relationship may be defined between the polygon and the socket opening such that there is not a direct one-to-one correspondence but some other correspondence. For example, a three sided anvil may engage with a six sided socket with positive results. As such, such additional combinations are intended to be included within the teachings of the present disclosure.

The anvil 10 also defines a plurality of grooves 46 on the corners 48 of the male square portion 30. The grooves 46 may provide stress relief by diverting the load from the base of the male square portion 30. The cone shaped transition portion 28 complements the countersink on the socket 40 engaged with the anvil 10 to relieve loading on the male square portion 30. The anvil 10 can have any other suitable construction and may be used with any type of power tool in accordance with other embodiments.

An advantage of the cone-shaped transition portion 28 is that it reduces the load imposed on the corners 48 of the male square portion 30 of the anvil 10 and the corners of the socket 42 and provides an increased area for sustaining the load. In this regard, the axial impact load imposed by the rotary tool 12 can be significant and often tends to split the socket 42. The cone-shaped transition portion 28 of the anvil 10 to better accommodate that axial impact load.

The drive body 24 includes the square portion 30 and the drive end 32. A channel 36 is formed between or is provided between the end 32 and the body or portion 30 for receiving the friction ring. As noted above the friction ring may be an O-ring, split ring or any other type of friction structure which can be retained in a similar manner. In one embodiment the friction ring is an elastomeric structure which helps provide an interference fit between the anvil and the socket. Additionally, it is envisioned that structures of various forms may be directly molded onto the body in a manner which might eliminate the need for a channel 36 but would provide the same function as the friction ring 38. Additionally, it is anticipated that the friction ring might be replaced with a friction device such that structures are formed at the appropriate locations relative to the flap 34 to provide the desired interference fit.

Figure 2:
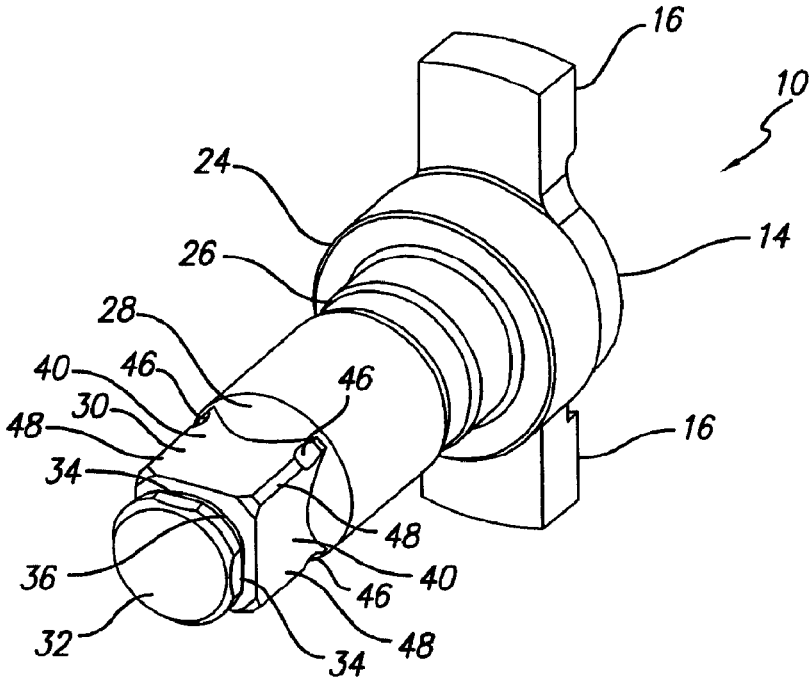
FIG. 2 is a perspective view of an anvil in accordance with an embodiment of the present disclosure having a drive end position at one end of the anvil with engaging flanges positioned distal the drive end, the drive end including structures for engagement with a socket with which the anvil is engaged for driving by the tool.
Figure 3:
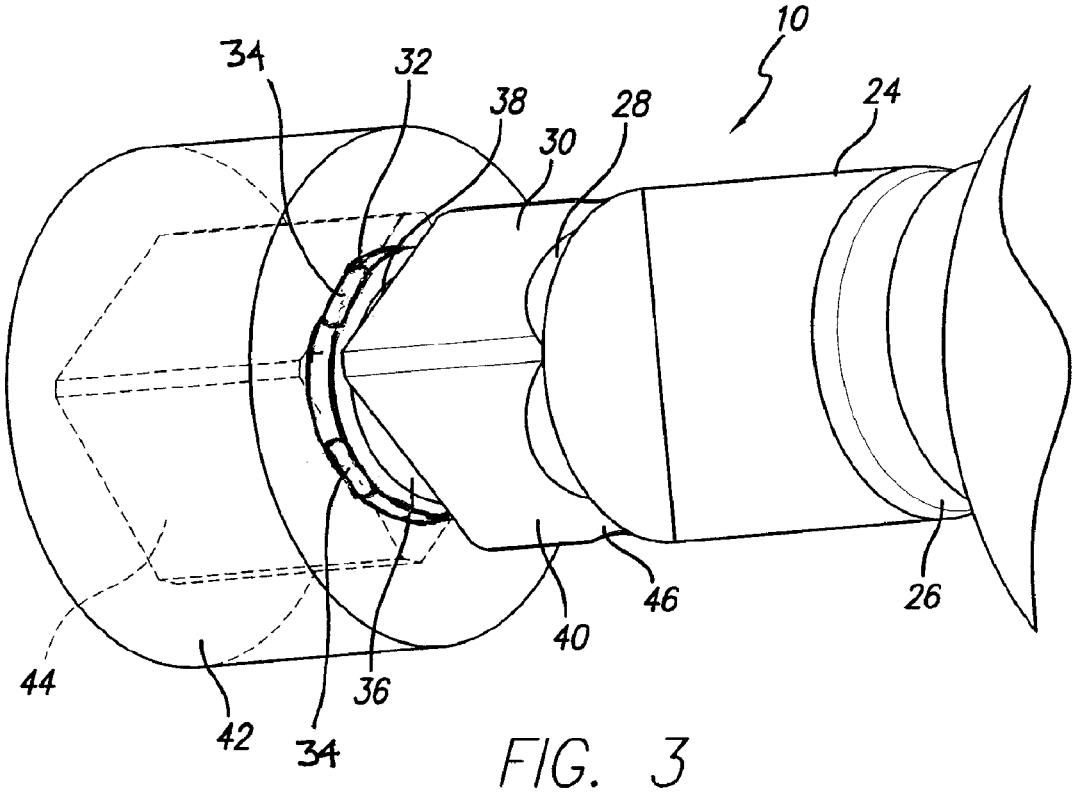
FIG. 3 is an enlarged broken view of the end of the anvil of FIG. 2 engaging a socket, the socket being shown in phantom line to illustrate the representation between the anvil and socket showing a drive end engaging an entry end of the socket.
Figure 4:
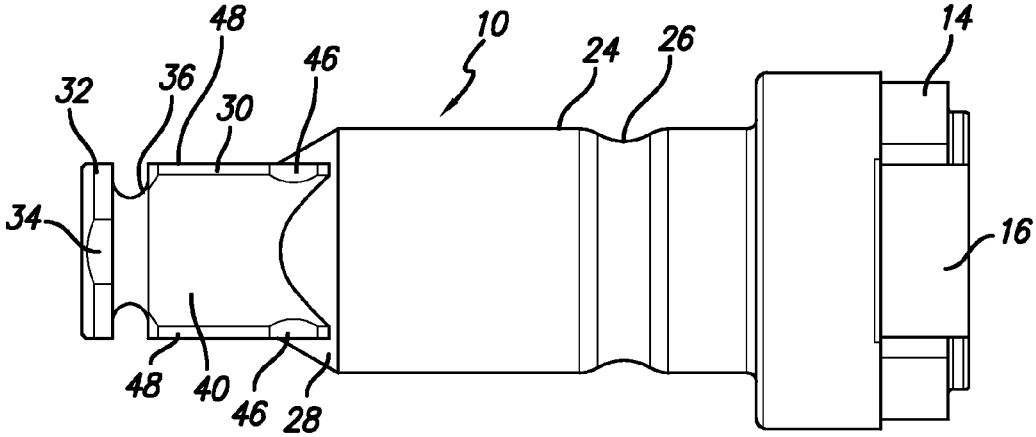
FIG. 4 is a side elevational view of the anvil of FIG. 2, a friction ring has been removed from a groove formed between the drive end and a square portion in illustrating grooves on corners of the square portion spaced from the channel and drive end generally proximate to a transition portion to a drive body.
Figure 5:
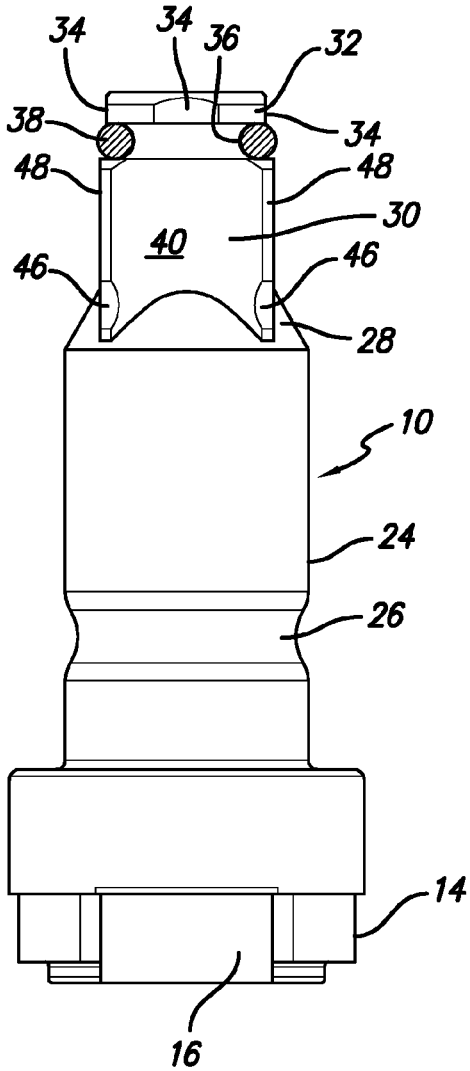
FIG. 5 is a side elevational view of the anvil of FIG. 2 and a friction ring engaged therewith in the channel and in which the ring extends slightly outwardly beyond corresponding flats on the drive end, the flats being correspondingly aligned with flat portions on the square portions.
Figure 6:
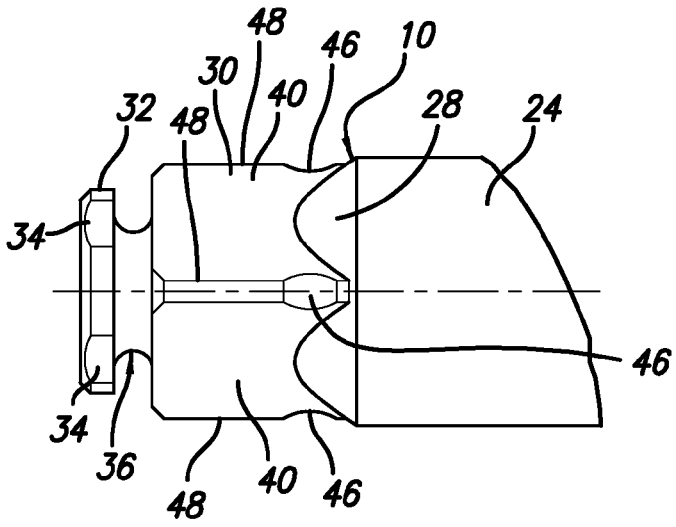
FIG. 6 is a side elevational view of the end of the anvil of FIG. 2, with the anvil being rotated 45° relative to FIG. 4 to further illustration relationships between structures of the drive end and the square portion to facilitate engagement between the anvil and the socket.
Figure 7:
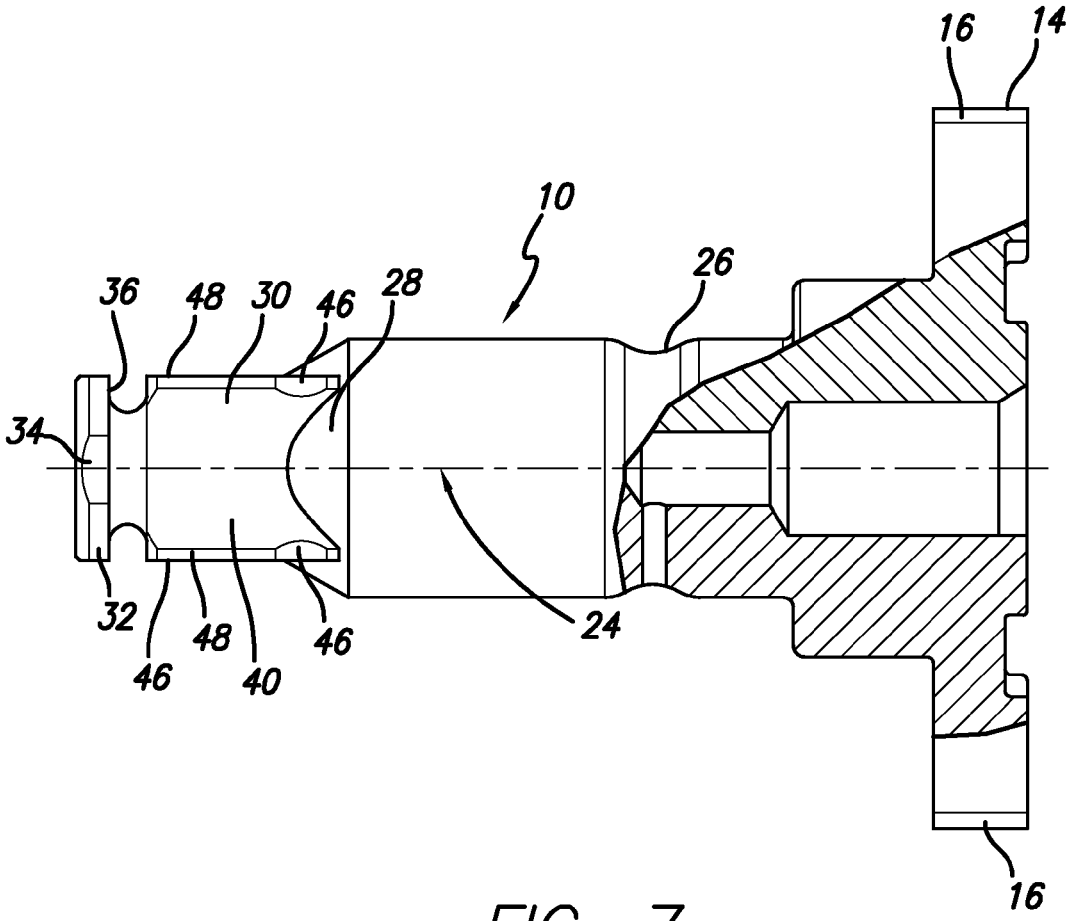
FIG. 7 is a partial fragmentary cross section of the anvil of FIG. 2.
Figure 8:
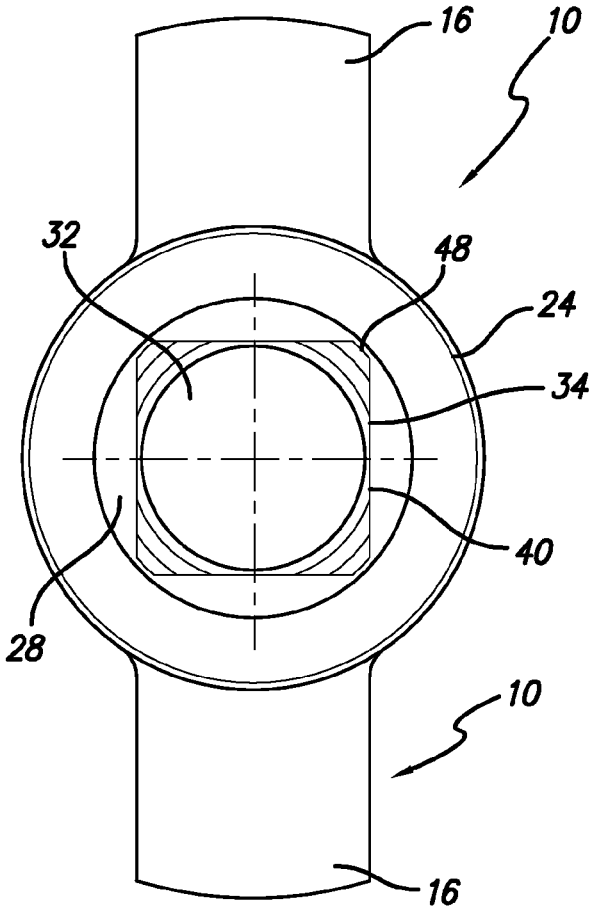
FIG. 8 is front plan view of the drive end of the anvil of FIG. 2 showing alignment of various structures as previously disclosed in the proceeding figures and in which the friction ring has been removed for purposes of illustration.
Figure 9:
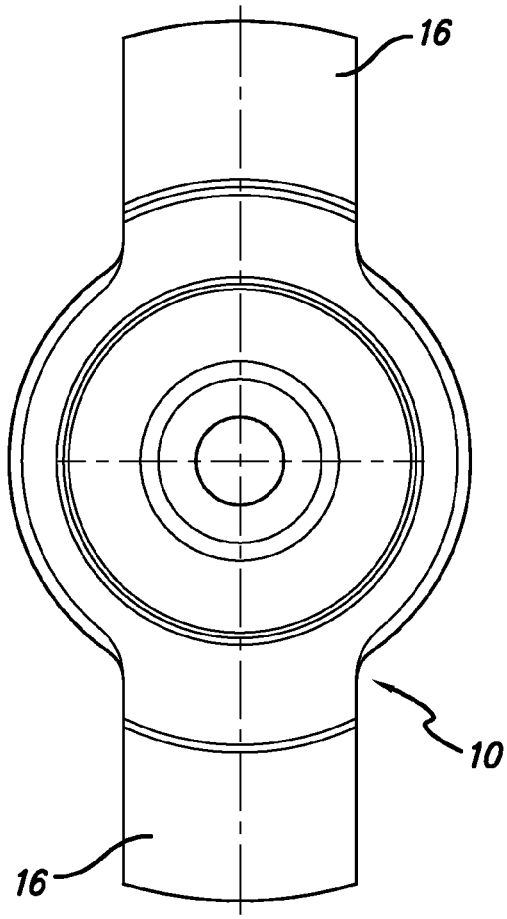
FIG. 9 is a front plan view of the other end of the anvil of FIG. 2.
Figure 10:
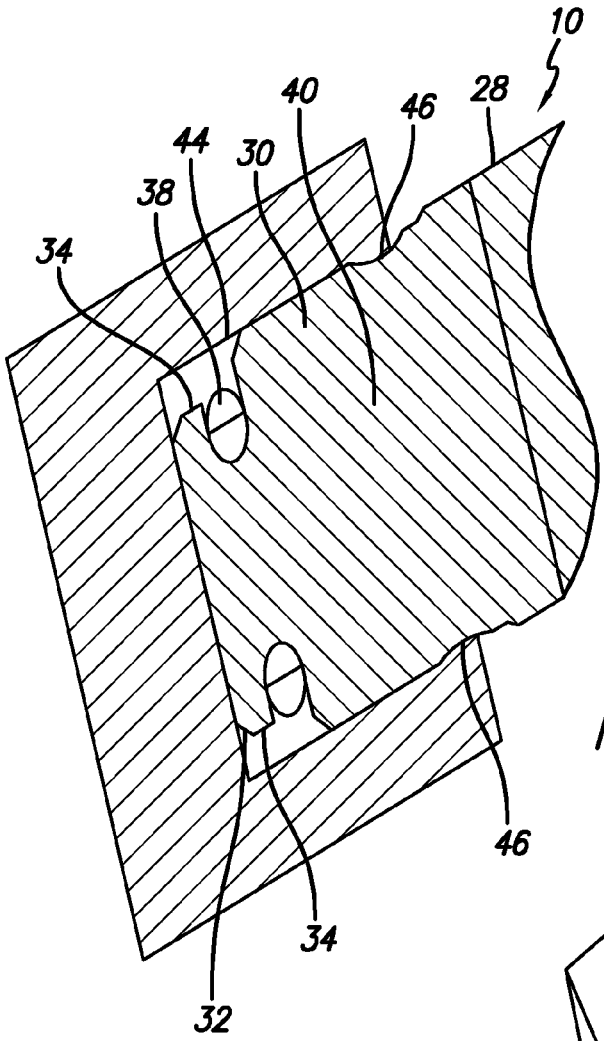
FIG. 10 is a drawing of a cross section of an anvil in accordance with an embodiment of the present disclosure engaged with an impact socket.
Figure 11:
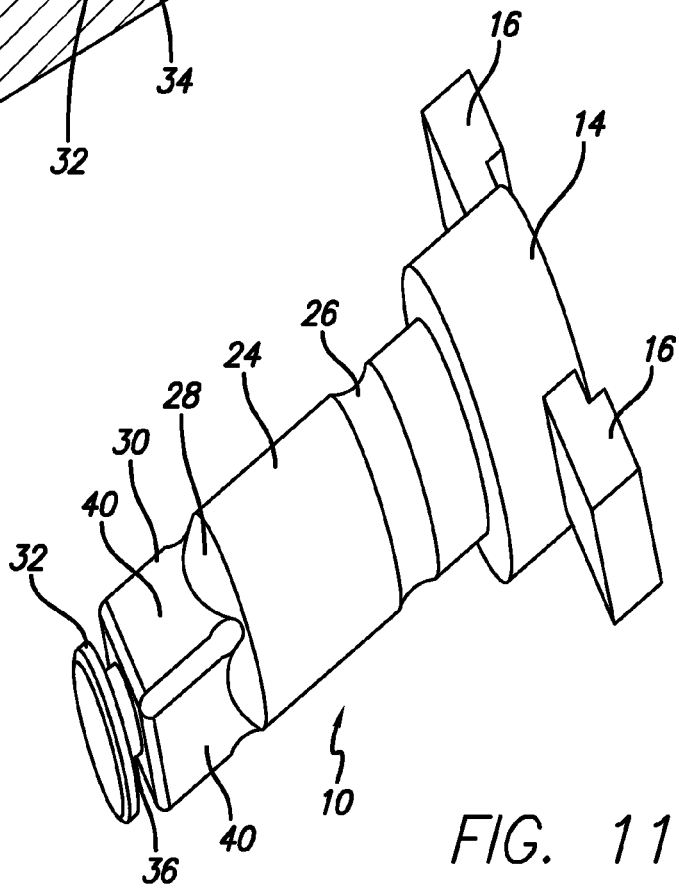
FIG. 11 is a drawing of a perspective view of an anvil in accordance with an embodiment of the present disclosure.

With reference to the figures and in particular FIG. 2, it can be seen that the end 32 provides a slightly smaller cross-sectional area than the portion 30. In this regard, the end provides some preliminary engagement between the anvil and the socket. The friction ring extends generally at least partially radially away from the anvil in correspondence with the flats for providing a degree of engagement between the anvil and the socket. This helps to positively engage the end of the anvil with the socket. The o-ring trailing behind the end helps to provide some degree of interference fit once the anvil and socket have been aligned thereby helping to promote additional alignment between the portion and the socket.

The ring generally corresponds to the diameter of the end 32 with a portion of the ring extending beyond the end 32 in the areas where the flaps 34 are provided. In other words, while the ring is somewhat concealed in the channel 36 at the curved portion of the end 32, at least a portion of the outside surface of the ring is exposed to and provides engagement with the inside walls of the socket in the areas where the flats 34 are formed in the end 32.

Further down, relief grooves 46 are provided on the beveled corners 48 of the portion 30. The relief grooves 46 are provided to relieve stress on the corners by keeping a load away from the base of the drive body. In other words, relieving the corners at this transition point should eliminate engagement of the drive body and the corresponding inside corner of the socket thereby relieving stress.

As noted above, the cone shape is provided to generally engage a corresponding counter sink in the socket. Generally corresponding matching of the cone and socket cutter sink provide load distribution to relieve some stress in loading on the square. This is particularly useful in an application such as an impact tool, shown in FIG. 1, in which an axial pounding or driving force is applied to the anvil. The generally large or increased area of the cone and corresponding counter sink help to spread this load over a larger area and minimize loading on the corners.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the disclosure are desired to be protected. The description and figures are intended as illustrations of embodiments of the disclosure, and are not intended to be construed as containing or implying limitation of the disclosure to those embodiments. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure.

The invention claimed is:

1. An anvil for use with a tool, the anvil comprising:

a drive body;

a drive end of the anvil having a generally circular structure;

a channel defined between the drive end and the drive body;

a friction structure at least partially retained in the channel;

at least a portion of the drive end proximate the friction structure defining flats;

the drive body defining a polygonal shape having flattened sides, the flats on the drive end being oriented aligned with the flattened sides on the drive body with the flats positioned on outer circumferential portions of the generally circular drive end;

intersecting edges of neighboring flattened sides of the polygonal drive body defining beveled edges between the neighboring flattened sides;

the friction structure extends generally at least partially radially away from the anvil in correspondence with the flats for providing a degree of engagement between the anvil and a socket and wherein the friction structure only extends slightly outward along the flats;

a transition cone positioned on the drive body generally distal the drive end and the polygonal drive body for accommodating axial impact loads; and relief grooves positioned on the beveled edges generally distal the drive end of the anvil and proximate the transition cones for providing stress relief in the anvil.

2. The anvil of claim 1, wherein the friction structure is a friction ring retained in the channel.

3. The anvil of claim 2, wherein the friction ring is an elastomeric member retained in the channel.

4. The anvil of claim 2, wherein the friction ring is a slip ring retained in the channel.

5. The anvil of claim 2, wherein the friction ring is a clip ring retained in the channel.

6. The anvil of claim 1, wherein the friction structure extends generally at least partially radially away from the anvil for providing a degree of engagement between the anvil and a socket.

7. The anvil of claim 1, wherein the channel is a generally at least partially arcuate groove extending generally circumferentially about the anvil between the drive end and the drive body.

8. The anvil of claim 1, wherein the flats are positioned on outer circumferential portions of the drive end, and the friction structure extends generally at least partially radially away from the anvil in correspondence with the flats for providing a degree of engagement between the anvil and a socket.

9. The anvil of claim 1, wherein the drive body defines a polygonal shape having flattened sides, the flats on the drive end being oriented to correspond to the flats on the drive body.

10. The anvil of claim 1, wherein the polygonal shape corresponds to a square.

11. The anvil of claim 1, where in the polygonal shape of the anvil cooperates with a corresponding shape of a female anvil receiving portion of a socket for use with the anvil.

12. The anvil of claim 1, the drive body further defining a polygonal shape having flattened sides, the flats on the drive end being oriented to correspond to the flats on the drive body, and intersecting edges of neighboring sides of the polygonal drive body defining beveled edges between the neighboring sides.

13. The anvil of claim 1, the drive body further defining a polygonal shape having flattened sides, and intersecting edges of neighboring sides of the polygonal drive body defining beveled edges between the neighboring sides.

14. The anvil of claim 13, further comprising relief grooves positioned on the beveled edges generally distal the drive end of the anvil for providing stress relief in the anvil.

15. The anvil of claim 13, further comprising a transition cone positioned on said drive body generally distal the drive end and the polygonal drive body.

16. The anvil of claim 1, wherein the flats are between the channel and the drive end.

17. The anvil of claim 1, wherein the flats are spaced on the periphery of the drive end.

18. An anvil for use with a tool, the anvil comprising:

a drive body defining a generally polygonal shape having flattened sides;

a drive end of the anvil having a generally circular structure;

a generally at least partially concave arcuate channel extending generally circumferentially about the anvil between the drive end and the drive body;

at least a portion of an outer circumferential surface of the drive end defining flats, the flats on the drive end being oriented to correspond to the flattened sides on the drive body;

a friction ring at least partially retained in the channel with at least a portion of an outer portion of the friction ring extending generally at least partially radially away from the anvil for providing a degree of engagement between the anvil and a socket and wherein the friction structure only extends slightly outward along the flats;

intersecting edges of neighboring flattened sides of the polygonal drive body defining beveled edges between the neighboring flattened sides;

a transition cone positioned on the drive body generally distal the drive end and the polygonal drive body for accommodating axial impact loads; and relief grooves positioned on the beveled edges generally distal the drive end of the anvil and proximate the transition cone for providing stress relief in the anvil.

19. The anvil of claim 18, wherein the friction ring is an elastomeric member retained in the channel.

20. The anvil of claim 18, wherein the polygonal shape corresponds to a square.

21. The anvil of claim 18, where in the polygonal shape of the anvil cooperates with a corresponding shape of a female anvil receiving portion of a socket for use with the anvil.

22. The anvil of claim 18, the flats on the drive end being oriented to correspond to the flats on the drive body, and intersecting edges of neighboring sides of the polygonal drive body defining beveled edges between the neighboring sides.

23. The anvil of claim 18, the drive body further defining a polygonal shape having flattened sides, and intersecting edges of neighboring sides of the polygonal drive body defining beveled edges between the neighboring sides.

24. The anvil of claim 23, further comprising relief grooves positioned on the beveled edges generally distal the drive end of the anvil for providing stress relief in the anvil.

25. The anvil of claim 18, further comprising a transition cone positioned on said drive body generally distal the drive end and the polygonal drive body.

* * * * *